US008187046B2

(12) United States Patent
Rolla et al.

(10) Patent No.: US 8,187,046 B2
(45) Date of Patent: May 29, 2012

(54) MARINE POWER SPLITTING GEARBOX

(75) Inventors: Philip Rolla, Bruzella (CH); Mark B. Wilson, Palm City, FL (US)

(73) Assignee: Twin Disc, Inc., Racine, WI (US)

( * ) Notice: Subject to any disclaimer, the term of this patent is extended or adjusted under 35 U.S.C. 154(b) by 201 days.

(21) Appl. No.: 12/478,329

(22) Filed: Jun. 4, 2009

(65) Prior Publication Data

US 2010/0311291 A1 Dec. 9, 2010

(51) Int. Cl.
*B63H 20/14* (2006.01)

(52) U.S. Cl. ..... 440/75; 440/53

(58) Field of Classification Search ..... 440/52, 440/53, 57, 61 T, 75, 86, 79; 474/113, 117, 474/84, 86, 88; 464/160; 477/177, 178, 477/181

See application file for complete search history.

(56) References Cited

U.S. PATENT DOCUMENTS

| | | | | |
|---|---|---|---|---|
| 2,936,730 | A | 5/1960 | Patty, Jr. | |
| 3,881,444 | A * | 5/1975 | Sigg | 440/52 |
| 3,954,083 | A | 5/1976 | Frostrom | |
| 4,311,472 | A * | 1/1982 | Hiersig et al. | 440/75 |
| 4,382,797 | A | 5/1983 | Blanchard | |
| 4,565,532 | A * | 1/1986 | Connor | 440/57 |
| 4,790,782 | A * | 12/1988 | McCormick | 440/61 R |
| 4,815,996 | A | 3/1989 | Carr | |
| 4,976,638 | A | 12/1990 | Grinde | |
| 5,215,486 | A | 6/1993 | Rizikow | |
| 5,249,994 | A | 10/1993 | Finkl | |
| 5,279,509 | A | 1/1994 | Gifford | |
| 5,439,403 | A | 8/1995 | Rolla | |
| 5,494,466 | A | 2/1996 | Vernea | |
| 5,649,844 | A * | 7/1997 | Caricof et al. | 440/75 |
| 5,879,207 | A | 3/1999 | Edmon | |
| 6,547,610 | B2 | 4/2003 | Kim | |
| 6,652,336 | B1 | 11/2003 | Chambers | |
| 6,814,636 | B2 | 11/2004 | Nolen | |
| 7,070,469 | B2 | 7/2006 | Stallings | |
| 7,244,154 | B1 | 7/2007 | Connell | |
| 7,413,491 | B2 | 8/2008 | Kawamoto | |
| 7,431,620 | B1 | 10/2008 | Harley | |
| 7,442,103 | B1 | 10/2008 | Carr | |
| 2004/0127115 | A1 | 7/2004 | Nolen | |
| 2005/0070180 | A1 | 3/2005 | von Wolske | |
| 2006/0057910 | A1 | 3/2006 | Stallings | |
| 2006/0089062 | A1 | 4/2006 | Carr | |
| 2006/0172630 | A1 | 8/2006 | Kawamoto | |

FOREIGN PATENT DOCUMENTS

| | | |
|---|---|---|
| EP | 1332960 | 8/2003 |
| WO | 03064249 | 8/2003 |

* cited by examiner

*Primary Examiner* — Lars A Olson
(74) *Attorney, Agent, or Firm* — Boyle Fredrickson, S.C.

(57) ABSTRACT

A power splitting gearbox is provided that allows a single prime mover to distribute power, for example torque, to multiple final drive assemblies, such as surface drives or other final drives. The power splitting gearbox can be provided downstream from a marine transmission and can be mounted directly to a transom of a marine vessel. The gearbox can have a back wall that accepts and supports mounting surfaces of the multiple final drive assemblies such that the gearbox bears the weight of the multiple final drive assemblies. The gearbox has two outputs that rotate in opposing directions so that a pair of final drive assemblies mounted to the gearbox will counter-rotate a pair of propellers for providing a propulsive force that moves the marine vessel.

20 Claims, 4 Drawing Sheets

MARINE POWER SPLITTING GEARBOX

BACKGROUND OF THE INVENTION

1. Field of the Invention

The present invention relates generally to marine powertrains and more specifically to systems for transmitting power from prime movers to propulsion devices, such as propellers.

2. Discussion of the Related Art

It is known that a marine vessel having a single engine that drives a single propeller can experience a propeller torque effect that forces the marine vessel to list or roll. Marine vessels having multiple engines that drive multiple propellers in the same direction of rotation can also experience listing or rolling due to propeller torque effect. Propeller torque induced listing and rolling can make controlling marine vessels difficult at times.

Accordingly, some marine vessels include a pair of engines and transmissions that rotate a pair of propellers in opposite directions. This configuration is conventionally referred to as counter-rotating propellers and it can reduce such propeller torque effects on the marine vessel. However, since most internal combustion engines are setup to operate in a single rotational direction (of their crankshafts), in order to provide a pair of counter-rotating propellers behind a pair of engines requires different configurations of the transmissions and/or final drives for each side of the marine vessel. This can lead to added expense and complexity of the design of the systems, since the components, including geometry, of the starboard side powertrain and the port side powertrain are not identical.

Furthermore, typical (i) single engine/single propeller configurations, and (ii) twin engine/twin propeller configurations, require final drive assemblies that can handle the entire torque or power output of the engine(s). Accordingly, marine vessels that utilize high torque or power outputting engines require final drive assemblies that are quite large, heavy, and expensive.

Other attempts have been made to increase propulsive efficiency and reduce propeller torque effect by providing a pair of propellers that are axially aligned, abutting each other, and driven through the same final drive assembly, but in opposite directions. This configuration is conventionally referred to as contra-rotating propellers. However, providing contra-rotating propellers typically requires a concentrically arranged pair of drive shafts, whereby the outer drive shaft must be hollow which can compromise its strength and add expense and complexity to the design.

Each of the prior systems fail to provide a solution to the problem of providing a highly efficient yet strong and compact marine drive system that uses multiple propellers in high powered marine applications.

Accordingly, there was a need for a marine power splitting gearbox that can input power from a single prime mover and distribute the power to a pair of counter-rotating propellers. A solution which minimizes complexity without compromising integrity was preferred.

SUMMARY OF THE INVENTION

The present invention is directed to a power splitting gearbox for use with a marine powertrain system of a marine vessel. The preferred embodiments provide a marine power splitting gearbox that can incorporate existing final drive assemblies while providing counter-rotating propellers that are driven with fewer engines than the total number of propellers. By splitting the power output from a single prime mover for distribution through two final drive assemblies that counter-rotate a pair of propellers, smaller final drive assemblies can be implemented since they only require a half-torque or power capacity as compared to the total torque or power output of the prime mover. Smaller final drive assemblies can use smaller diameter propellers with a higher pitch/diameter ratio coefficient that increases propulsion efficiency of the system. Such feature can also lead to less boat draft and improved handling of the marine vessel.

The power splitting gearbox includes a gearbox housing fixed with respect to a transom of a marine vessel. A gear train is mounted within the gearbox housing. The gear train accepts power from a prime mover of a marine powertrain system and splits the power into multiple power output components. The power output components are outputted by the gear train at multiple separate locations. Multiple surface drive assemblies are coupled to the gearbox such that each of the multiple surface drive assemblies accepts at least one of the multiple power output components from the gear train. The gear train is adapted to maintain a constant relative position with respect to the transom of the marine vessel while relative orientations of at least a portion of each of the multiple surface drive assemblies is adjusted for trim and steering. By maintaining such constant relative position, or fixing the gear train with respect to the transom, there are fewer instances of the rotating components of the gear train introducing gyroscopic torque effects into the steering or other systems of the vessel, as compared to gear boxes that move in unison with the steered components. In one embodiment of the power splitting gearbox according to the present invention, the gearbox housing is mounted to an outboard surface of a transom of the marine vessel. Portions of the multiple surface drive assemblies may be fixedly attached to the gearbox housing and define a surface drive spacing width therebetween. Further, a width of the gearbox housing may be greater than the surface drive spacing width such that the gearbox housing extends transversely beyond the portions of the surface drive assemblies that are fixedly attached to the gearbox housing.

In one embodiment of the present invention, the gear train may include multiple helical gears that intermesh with one another. In addition, the gear train may include at least four gears that are radially aligned with each other and intermesh at respective outer circumferential surfaces thereof, such that at least a first pair of the at least four gears rotate in a first direction and at least a second pair of the at least four gears rotate in a second, opposite, direction. Further, a first one of the multiple surface drive assemblies may be driven by a gear from the first pair of the at least four gears and a second one of the multiple surface drive assemblies may be driven by a gear from the second pair of the at least four gears, such that a pair of propellers that are driven by the first and second surface drive assemblies rotate in opposing directions. In another embodiment, reduction of a magnitude of propulsion induced torque on the marine vessel may be carried out by rotation of the pair of propellers in opposing directions.

The present invention is also directed to a marine power splitting propulsion system. The system includes a power splitting gear gearbox inputting power from a prime mover and dividing the power into multiple power components. Multiple final drives are operably connected to the power splitting gearbox. Each of the multiple final drives imputing a respective one of the multiple torque or power components such that each of the multiple final drives can be subjected to less than the entire power provided by the prime mover, allowing relatively smaller, less expensive, and more hydrodynamic final drives, to be incorporated, as compared to if each final drive was required to handle the entire torque or power output of the engine. Multiple clutch assemblies are provided between the multiple final drives and the power splitting gearbox such that the power inputted from the prime mover can be directed to a single one of the multiple final drives.

The marine power splitting propulsion system according the present embodiment may be configured such that each of the final drives is a surface drive assembly. The multiple surface drive assemblies may be articulatable for trimming and steering a marine vessel incorporating the marine power splitting propulsion system according to the present embodiment. The multiple surface drive assemblies may include a first surface drive assembly that rotates a first propeller in a first direction and a second surface drive assembly that rotates a second propeller in a second, opposite, direction. At least one of the multiple clutch assemblies may be modulatable thereby allowing the power from the prime mover to be variably divided into the multiple power components.

In another embodiment of the present invention, a marine power splitting propulsion system includes a power splitting gearbox inputting power from a prime mover and dividing the power into multiple power components. The power splitting gearbox is mounted to a transom of a marine vessel and has a gearbox mounting surface area defined by a surface area of an interface between the transom and the power splitting gearbox. Multiple final drives are operably connected to the power splitting gearbox. Each of the multiple final drives includes a final drive mounting surface area defined by a surface area of an interface between the final drive and at least one of the power splitting gearbox or transom. The gearbox mounting surface area is at least two times larger than the final drive mounting surface area. Providing a relatively larger mounting surface area spreads out the application of the final drive propulsive force, distributing it over a correspondingly larger greater area. This can reduce transom flexing, the reduction of which can increase the efficiency of the transfer of propulsive force into movement of the hull or marine vessel. This can also prolong a use life of the transom by reducing frequency and magnitude of potentially fatiguing occurrences of localized transom flexing and deformation. A first power splitting gearbox may be provided at starboard side of a transom of a marine vessel and a second power splitting gearbox is provided at a port side of the transom of the marine vessel in the system of the present embodiment. Each of the first and second power splitting gearboxes may include a pair of final drives operably connected thereto. Further, the system of the present embodiment may be configured such that the multiple final drives operably connected to the first power splitting gearbox include a pair of surface drive assemblies that drive a corresponding pair of counter-rotating propellers, and the multiple final drives operably connected to the second power splitting gearbox may include a pair of surface drive assemblies that drives a corresponding pair of counter-rotating propellers.

The system according to the present embodiment may further be configured such that the first power splitting gearbox receives power from a first prime mover and the second power splitting gearbox receives power from a second prime mover such that power from the first and second prime movers deliver propulsive power to the marine vessel by way of four propellers, including a pair of counter-rotating propellers at each of the starboard and port sides of the transom of the marine vessel.

Further, an innermost positioned pair of propellers may rotate in opposing directions with respect to each other and an outermost positioned pair of propellers rotate in opposing direction with respect to each other.

In yet another embodiment of the marine power splitting propulsion system according to the present invention a gearbox is mounted to an outwardly facing surface of a transom of a marine vessel. The gearbox includes a gearbox input provided at a forward end of the gearbox and accepting power from a prime mover of a marine powertrain system. Multiple gearbox outputs are provided at a rearward end of the gearbox. A back wall facing away from the transom is also provided. The multiple gearbox outputs are accessible through the back wall. Multiple final drives mounted to the back wall of the gearbox are also provided. Each of the multiple final drives is operably coupled to a respective one of the multiple gearbox outputs such that power that is received by the gearbox input is delivered as a propulsive force through the multiple final drives for moving the marine vessel.

Each of the final drives may include a mounting surface at a forward end thereof, the mounting surface interfacing the back wall of the gearbox. Further, each of the final drives may include an input shaft that is concentrically received by a respective one of the multiple gearbox outputs.

In yet another embodiment of the invention, the power splitting gearbox includes multiple inputs for accepting power therein. This can provide multiple mounting options to facilitate retrofitting or fitting to different original equipment powertrain configurations. Furthermore, the multiple inputs of the power splitting gearbox allow multiple prime movers to be attached to a single gearbox. For example, a prime mover and a secondary power source can be operatively connected to and deliver power to the power splitting gearbox. The secondary power source can supplement the power delivered by the prime mover by delivering power simultaneously therewith; optionally, the secondary power source can provide power to the power splitting gearbox when the prime mover does not.

In some embodiments, the secondary prime mover is an electric motor that can, at times, solely provide propulsive power for the marine vessel without contribution from the prime mover. By operating under electric power only, the marine vessel can, for example, troll, operate in a silent or stealth mode, berth or moor, and/or compensate for a non-operational prime mover, without running an internal combustion engine. The electric motor can be further configured as a component of a generator or gen-set. In such implementations, when the electric motor is not providing propulsive power, it can be driven by the prime mover to generate electrical power that is stored in batteries 11. The electric motor can be directly connected to a final drive assembly and such final drive assembly can be selectively coupled to the gear train with a clutch assembly. This allows the electric motor to drive only one of the multiple final drive assemblies of the marine power splitting propulsion system, as desired by the operator.

These and other aspects and objects of the present invention will be better appreciated and understood when considered in conjunction with the following description and the accompanying drawings. It should be understood, however, that the following description while indicating preferred embodiments of the present invention is given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
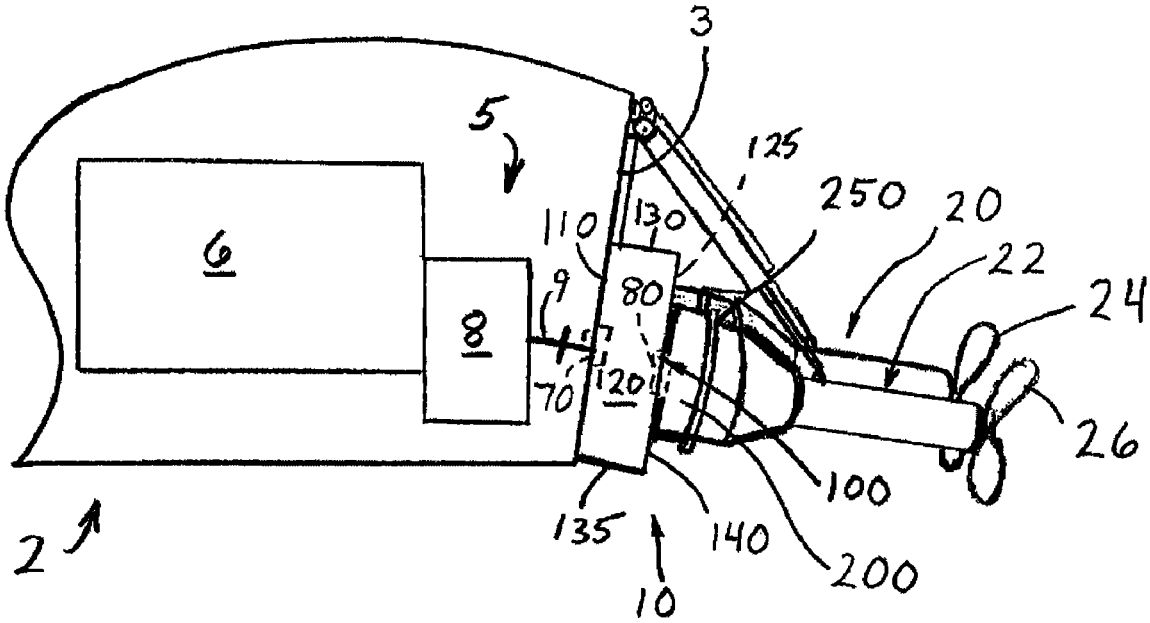
FIG. 1 is a side elevation, schematic representation, of a marine power splitting gearbox in accordance with the present invention, incorporated into a powertrain of a marine vessel.

With reference now to the drawings, and particularly to FIG. 1, there is shown a cross-sectional schematic view of an aft portion of a marine vessel 2 that has a transom 3 and includes a powertrain system 5. The powertrain system 5 utilizes one or more prime mover 6 that is preferably an internal combustion engine. A transmission 8 is operably connected to the prime mover 6, behind or downstream of the prime mover 6. Transmission 8 is preferably an MGX-series transmission (QuickShift® transmission) or an MG-series transmission, available from Twin Disc, Inc. headquartered in Racine, Wis. Each series of prime mover 6 and transmission 8 is connected to a power splitting gearbox 10, for example by way of a transmission output shaft 9. Power splitting gearbox 10 converts power that is delivered from the prime mover 6 into multiple power components for counter-rotating a pair of propellers 24, 26 provided on a pair of final drive assemblies 20, 22, respectively. Each final drive assembly 20, 22 is preferably a marine surface drive, for example an ARNESON™ surface drive available from Twin Disc, Inc., noting that other final drives, including submerged-type final drives, are also contemplated and well within the scope of the invention.

Figure 2:
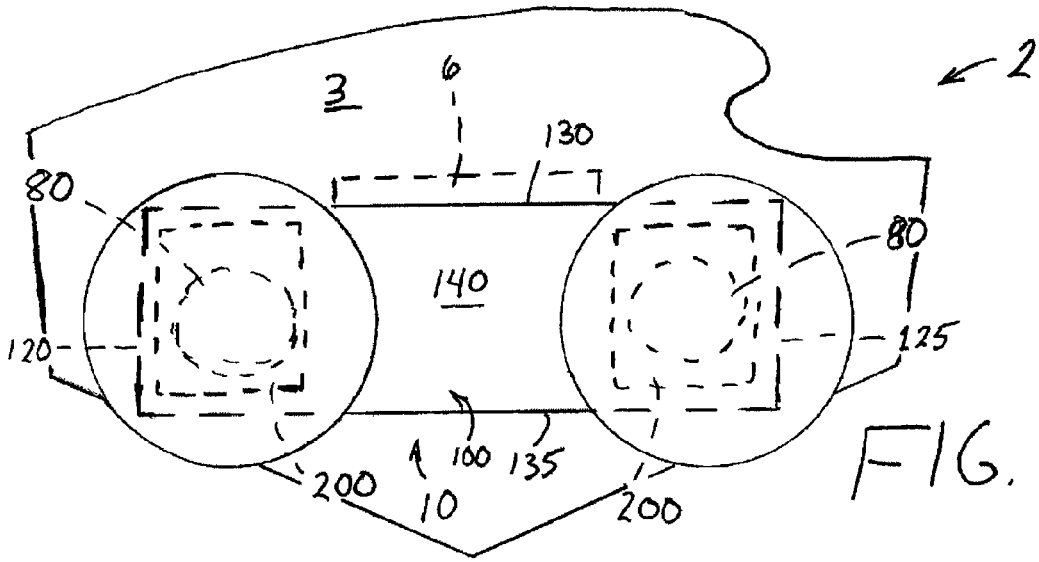
FIG. 2 is a rear elevation, schematic representation, of the marine vessel shown in FIG. 1.
Figure 3:
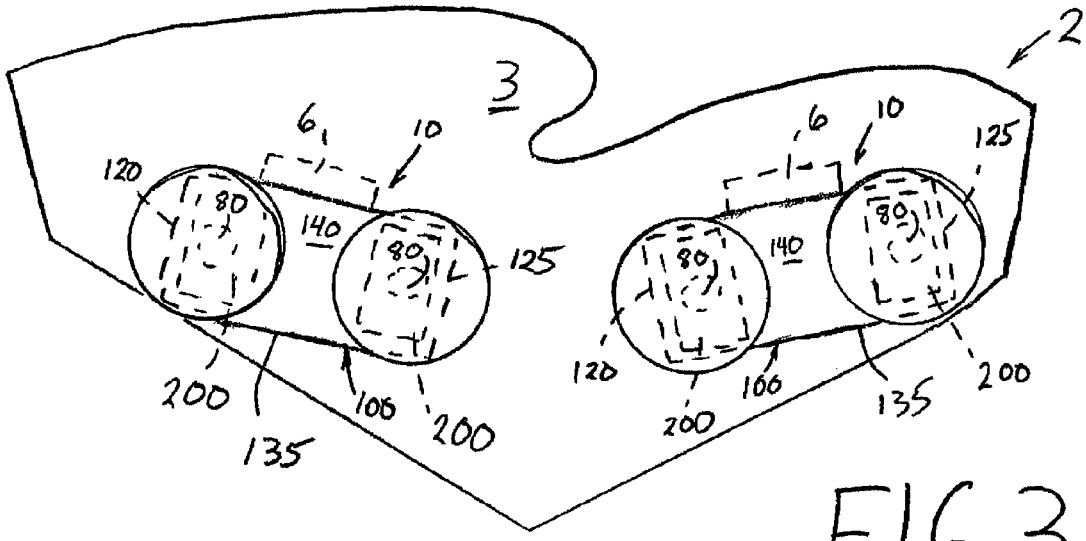
FIG. 3 is a rear elevation, schematic representation, of a variant of the marine vessel shown in FIG. 1, incorporating two prime movers, and two marine power splitting gearboxes driving two pairs of counter-rotating propellers.

Referring now to FIGS. 1-3, power splitting gearbox 10 provides an interface between the marine vessel 2 and the final drive assemblies 20, 22 while inputting power from the prime mover 6 and dividing and distributing the power (or components thereof) to the final drive assemblies 20. In this regard, power splitting gearbox 10 allows a marine vessel with a single engine to utilize a pair of counter-rotating propellers (FIG. 2). Correspondingly, by using a pair of power splitting gearboxes 10, a marine vessel that has two engines can utilize two pairs of counter-rotating propellers (FIG. 3), whereby four total propellers, including a pair of counter-rotating propellers at each of the starboard and port sides of the transom 3, are incorporated into the marine vessel 2. In this regard, power splitting gearboxes 10 can be incorporated into a marine vessel 2 directly from the factory or aftermarket installer, before purchase by an end-use consumer to provide (i) a single engine, twin-counter-rotating propeller powertrain (FIG. 2), (ii) a twin engine, quad-counter-rotating propeller powertrain (FIG. 3), or (iii) other powertrains that incorporate one or more pairs of counter-rotating propellers that are powered by, for example, half the number of prime movers as the total number of propellers in the powertrains.

Referring now to FIGS. 1-4, power splitting gearbox 10 includes a gearbox housing 100 that connects to the marine vessel 2 and at least partially encapsulates a gear train 150 or other various components of the power splitting gearbox 10. The gearbox housing 100 mechanically attaches and provides an interfacing structure between the final drive assemblies 20, 22 and the transom 3. This is because the gearbox housing 100 attaches to the transom 3, and the final drive assemblies 20, 22 attach to the gearbox housing 100. Since gearbox housing 100 connects the final drive assemblies 20, 22 to the transom 3, it also distributes the application of propulsive forces delivered through the final drive assemblies 20, 22 as well as the weight of the power splitting gearbox 100 and final drive assemblies 20, 22 to the transom 3.

Gearbox housing 100 attaches to transom 3 over a larger surface area than would final drive assemblies 20 if they were attached directly thereto. Gearbox housing 100 can therefore distribute in-use forces and loads over a larger surface area of the transom 3 than a pair of final drive assemblies 20 directly attached to the transom 3. Gearbox housing 100 correspondingly imparts a lower per-square-inch application of force onto the transom 3 which can reduce non-desired instances of transom 3 flexing.

The gearbox 100 can have a mounting surface area that is larger than, for example at least two-times larger than, the combined mounting surface area of the final drive assemblies 20. Such relatively large mounting surface area can be achieved by configuring gearbox 100 to extend transversely beyond the final drive assemblies 20. In other words, gearbox 100 can be wider than a distance defined between outermost surfaces of the mounting portions of drive assemblies 20, and can otherwise be dimensioned so that the gearbox 100 provides a sufficiently large mounting surface area to provide the desired load distribution characteristics with respect to transom 3.

Figure 4:
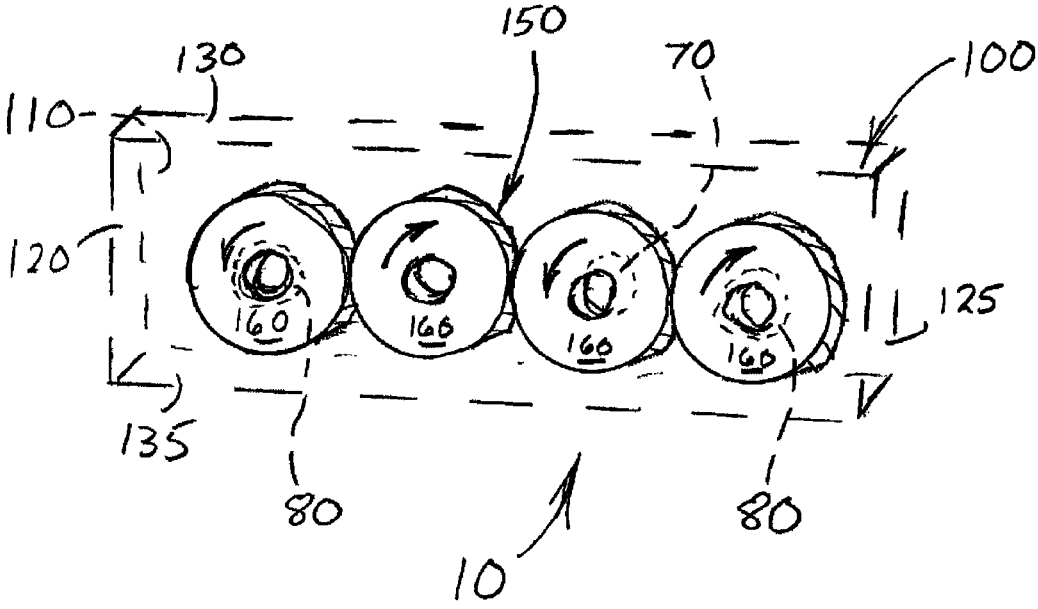
FIG. 4 is a schematic representation of a gear train of the power splitting gearbox of FIG. 1.

Referring now to FIGS. 1 and 4, gearbox housing 100 can include a front wall 110 that faces or abuts transom 3. The front wall 110 can mount directly to a rearward facing or outboard surface of the transom 3, while permitting access to one or more inputs 70 provided at a front end of the power splitting gearbox 10. Optionally, an auxiliary mounting structure, such as one or more mounting flanges or other mounting structures, extends from front wall 110 or other portion of the gearbox housing 100, for attaching it to the transom 3.

Still referring to FIGS. 1 and 4, forward facing edges of opposing sidewalls 120 and 125 connect to side portions of the front wall 110, and forward facing edges of top and bottom walls 130 and 135 attach to upper and lower portions of the front wall 110. The sidewalls 120, 125 and top and bottom walls 130, 135 extend back and away from the front wall 110, and are connected to each other by a back wall 140 to define an overall enclosure assembly of the gearbox housing 100.

Although the gearbox housing 100 components are described above as being configured for mounting the power splitting gearbox 10 to the rearward facing or outboard surface of transom 3 and thus outside of marine vessel 2, it can instead be configured for mounting inside of the marine vessel 2. In other words, the power splitting gearbox 10 can attach to a forward facing or inboard surface of transom 3 by fixing the back wall 140 to the front of transom 3 instead of fixing the front wall 110 to the back of transom 3. In such inboard mounted configurations, the transom 3 is sandwiched between the power splitting gearbox 10 and the final drive assemblies 20, 22 with fasteners drawing the power splitting gearbox 10 and the final drive assemblies 20, 22 toward each other so that they clamp against opposing surfaces of the transom 3. Preferably the power splitting gearbox 10 is also attached to the transom 3 by fasteners provided at other mounting locations, such as about a perimeter of back wall 140, to supplement the clamping force established between the power splitting gearbox 10 and the final drive assemblies 20 for holding them fixed with respect to the transom 3.

It is noted that a similar clamping-type mounting technique can be used in the more typical implementation of power splitting gearbox 10, where it is mounted outside of the marine vessel 2 and to the back of transom 3. This can be accomplished by using a backing plate on the front or forward facing side of the transom, and corresponding fasteners that squeeze the transom 3 between the backing plate and the power splitting gearbox 10, retaining the assembly in-place.

Referring now to FIG. 4, regardless of whether the gearbox housing 100 is mounted to the front or back surface of the transom 3, it holds and protects a gear train 150 therein. Since the gearbox housing 100 is fixed with respect to the transom 3, gear train 150 is also fixed with respect thereto, whereby the gear train 150 retains its alignment or position with respect to the transom 3 at all times, even when the final drive assemblies 20, 22 are being articulated for trimming or steering the marine vessel 2.

Still referring to FIG. 4, gear train 150 mechanically splits power received through input 70 for delivery through multiple outputs 80 that are accessible through back wall 140 and that drive the final drive assemblies 20, 22. The gear train 150 includes multiple gears 160 that intermesh with each other and therefore rotate simultaneously. Gears 160 preferably have helically cut teeth and are radially aligned with each other so that every other gear 160 of the gear train 150 rotates in the same direction, while gears 160 that are immediately adjacent each other rotate in opposing directions. Since adjacent, radially engaging gears rotate in opposite directions, intuitively, gears 160 that are spaced from each other by two intermediate gears (or a number of gears that is a multiple of two) will rotate in opposing directions. Correspondingly, the gear train 150 can input power into any one of the gears 160 in the gear train 150 and achieve counter-rotating outputs by delivering power through gears 160 that are spaced from each other by two intermediate gears 160 (or a number of gears that is a multiple of two).

Referring yet further to FIG. 4, as shown in this exemplary embodiment, if the gear train 150 has four gears 160, then the outputs 80 can be driven by the outermost gears that sit adjacent the sidewalls 120, 125 in a counter-rotating manner. This holds true regardless of which of the four gears is driven by the input 70. Accordingly, the particular one of the four gears that will be driven by input 70 is selected based on the intended end use implementation, for example based on a spatial relationship between the transmission output shaft 9 and the input 70 of the power splitting gearbox 10.

It is contemplated that input 70 and outputs 80 need not be separate and distinct components, apart from the gears 160, but rather can be integrated with individual ones of the gears 160. For example, input 70 can be a splined inner circumferential surface of one of the gears 160 that receives a splined end of the transmission output shaft 9. Likewise, outputs 80 can be splined inner circumferential surfaces of ones of the gears 160 that accept and drive splined ends of input shafts of the final drive assemblies 20, 22.

Referring again to FIG. 1, in some embodiments, outputs 80 are connected to clutches 200 that are interposed between the power splitting gearbox 10 and the final drive assemblies 20. The clutches 200 allow an operator to selectively engage and/or disengage final drive assemblies 20, 22 individually or together, as desired. Furthermore, clutches 200 can be modulatable for controlling relative amounts of power that are transmitted from the outputs 80 to respective final drive assemblies 20, 22.

Referring again to FIGS. 1-3, drive mounts 250 are the mounting structures to which the final drive assemblies 20, 22 attach. Accordingly, drive mounts 250 are provided on either the back wall 140 of the gearbox housing 100, or back ends of the clutches 200, if clutches 200 are used with the power splitting gearbox 10. The drive mounts 250 are configured to receive and hold forward facing ends of the final drive assemblies 20, 22 using fasteners, and/or corresponding structures such as shoulders, lips, and/or other mechanical interlocks that cooperate with mounting flanges at the front ends of the final drive assemblies 20, 22. In some implementations, drive mounts 250 also serve as mounting structures to which upper ends of hydraulic actuators that trim and steer the final drive assemblies 20, 22 attach.

Figure 5:
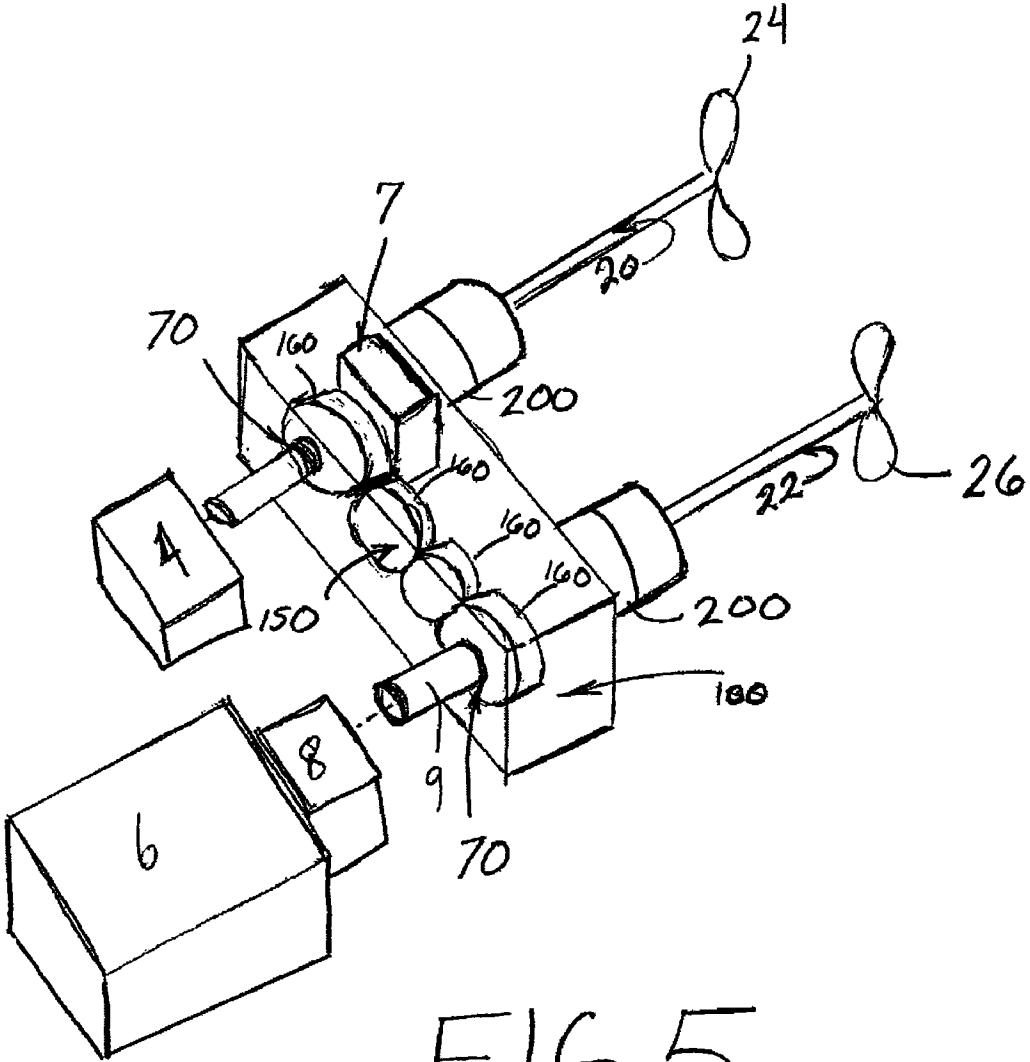
FIG. 5 is a schematic representation of a variant of the power splitting gearbox of FIG. 1, having multiple inputs and incorporating a secondary power source.

Referring now to FIG. 5, for embodiments that include multiple inputs 70, such multiple inputs 70 can (i) provide multiple mounting and positioning options which can facilitate retrofitting applications, and (ii) can allow multiple prime movers to provide power to a single power splitting gearbox 10, individually or combined, depending on the particular desired end-use configuration. For example, in addition to prime mover 6, a secondary power source 4 can be attached to the power splitting gearbox 10. In some embodiments, secondary power source 4 is an electric motor that can at times solely provide propulsive power for the marine vessel 2, without contribution from the prime mover 6. This configuration allows propulsion of the marine vessel 2 by electrical power only, as desired, for example, when trolling, when operating in a silent or stealth mode, when berthing or mooring, and/or if there is an operational failure of the prime mover 6.

Still referring to FIG. 5, the secondary power source 4 can be selectively connected to the power splitting gearbox 10 so that when it is engaged, it rotates both or only a single propeller 24, 26. For embodiments in which the secondary power source 4 rotates both propellers 24, 26, it operates in a manner largely analogous to that described above, whereby it rotates one of the gears 160 of the gear train 150 which, in turn, rotates the other gears 160 within the gear train 150 such that output shafts of the final drive assemblies 20, 22 rotate the propellers 24, 26 in opposite or counter rotating directions.

Still referring to FIG. 5, the secondary power source 4 can be selectively coupled to one of the final drive assemblies and also to the gear train 150, allowing the secondary power source 4 to rotate only a single one of the propellers 24, 26. This can be accomplished in any of a variety of suitable ways. For example, a clutch assembly 7 can be provided between the gear train 150 and final drive assembly 20, for engaging and disengaging them in driving communication with each other. Then, by coupling the secondary power source 4 to the final drive assembly 20, the secondary power source 4 can provide power to the final drive assembly 20 when the clutch assembly 7 disengages the gear train 150 from the final drive assembly 20.

Clutch assembly 7 is externally controlled, for example, by a control system for selecting which of the prime mover 6 and secondary power source 4 will be utilized at any given time, optionally by a stand-alone control system that controls only the clutch assembly 7. Regardless of the particular arrangements of such control systems, it is preferably configured so that a user's activation of the secondary power source 4 substantially simultaneously disengages the clutch assembly 7 and uncouples the gear train 150 from the final drive assembly 20, while the secondary power source 4 operably couples therewith. Various suitable clutch assemblies 7 that allow multiple prime movers to be operably coupled to a single gearbox can be seen in the assignee's own Provisional U.S.

patent application Ser. No. 61/152,061, filed on Feb. 12, 2009, and entitled Hybrid Marine Power Train System, which is hereby incorporated by reference in its entirety.

If the electric motor of secondary power source 4 is also configured as a generator or gen-set, then the secondary power source 4 can stay operably connected to the final drive assembly 20 at all times. In such embodiments, when the prime mover 6 provides propulsive power, then the secondary power source 4 is driven by the prime mover 6 and through the gear train 150 and/or final drive assembly 20, like an engine accessory, for generating electrical power that can be stored in batteries 11. Referring yet further to FIG. 5, regardless of whether the secondary power source 4 is selectively or continuously coupled to the final drive assembly 20, an overall drive ratio defined between the secondary power source 4 and final drive assembly 20 or propeller 24 can be a fixed ratio. Such fixed overall drive ratio is preferably selected to optimize the propulsion performance while using a single propeller 24 and a relatively less powerful prime mover, when compared to prime mover 6. In typical implementations, the overall drive ratio defined between the secondary power source 4 and propeller 24 is closer to a 1:1 ratio than an overall drive ratio defined between prime mover 6 and the propellers 24, 26.

Yet other arrangements can be included, depending on the particular desired end use configuration of the transmission. For example, if the gearbox housing 100 is made as a single casting that includes segments that can suitably hold bearings of the gears 160, the front and/or back walls 110 and 140, or portions thereof, may not be required, provided that the entire power splitting gearbox 10 is suitably sealed between itself, transom 3, and the final drive assemblies 20, 22.

Regardless, it is noted that many changes and modifications may be made to the present invention without departing from the spirit thereof. The scope of some of these changes is discussed above. The scope of others will become apparent from the appended statements of invention.

We claim:

1. A power splitting gearbox for use with a marine powertrain system of a marine vessel, the power splitting gearbox comprising:

a gearbox housing fixed with respect to a transom of a marine vessel;

a gear train mounted within the gearbox housing, the gear train accepting power from a prime mover of a marine powertrain system and splitting the power into multiple power output components that are outputted by the gear train at separate locations thereof;

multiple surface drive assemblies coupled to the gearbox such that each of the multiple surface drive assemblies accepts at least one of the multiple power output components from the gear train; and wherein the gear train maintains a constant relative position with respect to the transom of the marine vessel while relative orientations of at least a portion of the multiple surface drive assemblies is adjusted for trim and steering.

2. The power splitting gearbox of claim 1, wherein the gearbox housing is mounted to an outboard surface of a transom of the marine vessel.

3. The power splitting gearbox of claim 2, wherein portions of the multiple surface drive assemblies are fixedly attached to the gearbox housing and define a surface drive spacing width therebetween, and wherein a width of the gearbox housing is greater than the surface drive spacing width such that the gearbox housing extends transversely beyond the portions of the surface drive assemblies that are fixedly attached to the gearbox housing.

4. The power splitting gearbox of claim 1, wherein the gear train includes at least four gears that are substantially radially aligned with each other and intermesh at respective outer circumferential surfaces thereof, such that (i) at least a first pair of the at least four gears rotate in a first direction, and (ii) at least a second pair of the at least four gears rotate in a second, opposite, direction.

5. The power splitting gearbox of claim 4, wherein (i) a first one of the multiple surface drive assemblies is driven by a gear from the first pair of the at least four gears, and (ii) a second one of the multiple surface drive assemblies is driven by a gear from the second pair of the at least four gears, such that a pair of propellers that are driven by the first and second surface drive assemblies rotate in opposing directions.

6. The power splitting gearbox of claim 1, further comprising multiple inputs for accepting power thereinto, each of the multiple inputs being operably connected to at least one of (i) the gear train, and (ii) at least one of the multiple surface drive assemblies.

7. The power splitting gearbox of claim 6, wherein the prime mover is operably coupled to one of the multiple inputs and a secondary power source is operably coupled to another, different, one of the multiple inputs.

8. A marine power splitting propulsion system, comprising:

a power splitting gearbox mounted to a transom of a marine vessel and accepting power from a prime mover, the power splitting gearbox dividing the power into multiple power components;

multiple clutch assemblies operably connected to the power splitting gearbox, each of the multiple clutch assemblies selectively transferring a respective one of the multiple power components therethrough; and multiple final drive assemblies operably connected to and are downstream of the multiple clutch assemblies so that the multiple clutch assemblies are provided between the multiple final drive assemblies and the power splitting gearbox.

9. The marine power splitting propulsion system of claim 8, wherein each of the final drive assemblies is a surface drive assembly.

10. The marine power splitting propulsion system of claim 9, wherein each of the multiple surface drive assemblies is articulatable for trimming and steering the marine vessel.

11. The marine power splitting propulsion system of claim 10, wherein the multiple surface drives assemblies includes (i) a first surface drive assembly that rotates a first propeller in a first direction, and (ii) a second surface drive assembly that rotates a second propeller in a second, opposite, direction.

12. The marine power splitting propulsion system of claim 8, wherein at least one of the multiple clutch assemblies is modulatable, allowing the power from the prime mover to be variably transmitted to a respective one of the multiple final drive assemblies.

13. A marine power splitting propulsion system, comprising:

a power splitting gearbox inputting power from a prime mover and dividing the power into multiple power components, the power splitting gearbox mounted to a transom of a marine vessel and having a gearbox mounting surface area defined by a surface area of an interface between the transom and the power splitting gearbox;

multiple final drive assemblies operably connected to the power splitting gearbox, each of the multiple final drive assemblies having a final drive mounting surface area defined by a surface area of an interface between the final drive and at least one of the power splitting gearbox or transom; and wherein the gearbox mounting surface area is at least two-times larger than the final drive mounting surface area.

14. The marine power splitting propulsion system of claim 13, further comprising multiple clutch assemblies provided between the power splitting gearbox and the multiple final drive assemblies, such that the final drive mounting surface area is defined by a surface area of an interface between the final drive and at least one of (i) the power splitting gearbox, (ii) the transom, and (iii) the multiple clutch assemblies.

15. The marine power splitting propulsion system of claim 14, wherein a first power splitting gearbox is provided at a starboard side of a transom of a marine vessel and a second power splitting gearbox is provided at a port side of the transom of the marine vessel, each of the first and second power splitting gearboxes having a pair of final drive assemblies being operably connected thereto.

16. The marine power splitting propulsion system of claim 15, wherein (i) the multiple final drive assemblies that are operably connected to the first power splitting gearbox includes a pair of surface drive assemblies that drives a corresponding pair of counter-rotating propellers, and (ii) the multiple final drive assemblies that are operably connected to the second power splitting gearbox includes a pair of surface drive assemblies that drives a corresponding pair of counter-rotating propellers.

17. The marine power splitting propulsion system of claim 15, wherein the first power splitting gearbox receives power from a first prime mover and the second power splitting gearbox receives power from a second prime mover.

18. The marine power splitting propulsion system of claim 13, further comprising multiple inputs for receiving power thereinto and a secondary power source, wherein the prime mover is operably coupled to one of the multiple inputs and a secondary power source is operably coupled to another, different, one of the multiple inputs.

19. A method of propelling a marine vessel, comprising:

operating a prime mover;

accepting power generated by the prime mover into a gear train housed in a power splitting gearbox;

splitting the power in the gear train and outputting the power as multiple power components;

accepting the multiple power components into corresponding multiple clutch assemblies;

selectively transmitting the multiple power components through the clutch assemblies and to corresponding multiple final drive assemblies operably connected thereto and downstream thereof so that the multiple clutch assemblies are provided between the multiple clutch assemblies and the power splitting gearbox; and driving a pair of propellers with corresponding ones of the multiple final drive assemblies in opposing rotational directions.

20. The method of propelling a marine vessel of claim 19, wherein each of the final drive assemblies is a surface drive assembly.

* * * * *